US006662523B2

(12) United States Patent
Hornung et al.

(10) Patent No.: US 6,662,523 B2
(45) Date of Patent: Dec. 16, 2003

(54) INSULATING GLASS SASH ASSEMBLIES WITH ADHESIVE MOUNTING AND SPACING STRUCTURES

(75) Inventors: Robert Hornung, Southport, CT (US); John S. France, Cuyahoga Falls, OH (US)

(73) Assignee: Sashlite, LLC, Westport, CT (US)

( * ) Notice: Subject to any disclaimer, the term of this patent is extended or adjusted under 35 U.S.C. 154(b) by 26 days.

(21) Appl. No.: 09/882,295

(22) Filed: Jun. 15, 2001

(65) Prior Publication Data

US 2002/0189196 A1 Dec. 19, 2002

(51) Int. Cl.[7] ..... E04C 2/54

(52) U.S. Cl. ..... 52/786.13; 428/34

(58) Field of Search ..... 52/786.13, 788.1; 428/34

(56) References Cited

U.S. PATENT DOCUMENTS

| | | | |
|---|---|---|---|
| 309,636 | A | 12/1884 | Mann |
| 2,563,378 | A | 8/1951 | Schnee |

(List continued on next page.)

FOREIGN PATENT DOCUMENTS

| | | |
|---|---|---|
| CA | 728445 | 2/1966 |
| CH | 209284 | 6/1940 |
| CH | 340607 | 10/1959 |
| CH | 378513 | 7/1964 |
| CH | 433 675 | 9/1967 |
| DE | L 17545 | 12/1956 |
| DE | 1123457 | 2/1962 |
| DE | 1915245 | 10/1970 |
| DE | 2041038 | 2/1971 |
| DE | 25 27 013 | 1/1976 |
| DE | 24 49 726 | 4/1976 |
| DE | 24 57 472 | 6/1976 |
| DE | 26 14 049 | 6/1976 |

(List continued on next page.)

OTHER PUBLICATIONS

Marketing brochure entitled "The most advanced Insulating Glass System for today's most advance windows . . . ", Edgetech IG Inc., Cambridge, Ohio, May 1997.

Product Information Sheet, "Super Spacer Architectural S–Class", Edgetech IG Inc., Cambridge, Ohio, Sep. 1999.

Product Information Sheet, "Super Spacer Slimline S–Class", Edgetech IG Inc., Cambridge, Ohio, Sep. 1999.

Product Information Sheet, "Super Spacer Slimline E–Class", Edgetech IG Inc., Cambridge, Ohio, Sep. 1999.

Technical Data Sheet, "Super Spacer Cushion Edge", Edgetech IG Inc., Cambridge, Ohio, Dec. 1999.

Warm Edge Digest, North American Edition, vol. 1, No. 1, Edgetech IG Inc., Cambridge, Ohio, Winter 1997/98.

Warm Edge Digest, North American Edition, vol. 2, No. 2, Edgetech IG Inc., Cambridge, Ohio, Summer 1999.

*Primary Examiner*—Carl D. Friedman
*Assistant Examiner*—Kevin McDermott
(74) *Attorney, Agent, or Firm*—Barry R. Lipsitz

(57) ABSTRACT

An integrated multipane window sash is fabricated from a sash frame having an inside perimeter. An adhesive material is applied to the inside perimeter. The adhesive material has sufficient stiffness to function as a mounting structure for glazing panes, and may also function as a spacing structure. A first glazing pane is mounted to a first side of the adhesive mounting structure. A second glazing pane is mounted to a second side of the adhesive mounting structure or to a separate adhesive mounting structure. The adhesive mounting structure can be applied by co-extrusion with the sash profile, by post-extrusion, manually or automatically and can comprise, for example, at least one of a bead of adhesive, a preformed adhesive foam, a preformed adhesive tape, or a chemical sealant. The adhesive mounting structure can be combined with a desiccant.

24 Claims, 7 Drawing Sheets

U.S. PATENT DOCUMENTS

| | | | | | |
|---|---|---|---|---|---|
| 2,993,242 | A | | 7/1961 | Leisibach | |
| 3,008,196 | A | | 11/1961 | Springer et al. | |
| 3,030,673 | A | | 4/1962 | London | |
| 3,054,153 | A | | 9/1962 | Partsch | |
| 3,775,914 | A | | 12/1973 | Patil | |
| 3,791,910 | A | | 2/1974 | Bowser | |
| 3,872,198 | A | | 3/1975 | Britton | |
| 3,919,023 | A | | 11/1975 | Bowser et al. | |
| 3,990,196 | A | | 11/1976 | Eddins | |
| 4,015,394 | A | | 4/1977 | Kessler | |
| 4,055,031 | A | | 10/1977 | Okawa et al. | |
| 4,109,432 | A | | 8/1978 | Pilz | |
| 4,149,348 | A | | 4/1979 | Pyzewski | |
| 4,207,869 | A | | 6/1980 | Hart | |
| 4,208,849 | A | * | 6/1980 | Lamb | 52/203 |
| 4,368,226 | A | | 1/1983 | Mucaria | |
| 4,407,105 | A | | 10/1983 | Frank | |
| 4,454,703 | A | | 6/1984 | Sitzler et al. | |
| 4,459,789 | A | | 7/1984 | Ford | |
| 4,464,874 | A | | 8/1984 | Shea, Jr. et al. | |
| 4,479,988 | A | | 10/1984 | Dawson | |
| 4,499,703 | A | * | 2/1985 | Rundo | 156/109 |
| 4,552,790 | A | | 11/1985 | Francis | |
| 4,564,540 | A | | 1/1986 | Davies et al. | |
| 4,608,796 | A | | 9/1986 | Shea, Jr. | |
| 4,652,472 | A | | 3/1987 | Davies | |
| 4,753,056 | A | | 6/1988 | Pacca | |
| 4,791,762 | A | | 12/1988 | Hwang | |
| 4,831,799 | A | * | 5/1989 | Glover et al. | 52/171.3 |
| 4,850,175 | A | | 7/1989 | Berdan | |
| 4,873,803 | A | | 10/1989 | Rundo | |
| 4,928,448 | A | | 5/1990 | Phillip | |
| 4,952,430 | A | | 8/1990 | Bowser et al. | |
| 4,994,309 | A | * | 2/1991 | Reichert et al. | 156/109 |
| 5,007,217 | A | * | 4/1991 | Glover et al. | 428/34 |
| 5,061,531 | A | | 10/1991 | Catalano | |
| 5,097,642 | A | | 3/1992 | Richardson et al. | |
| 5,106,663 | A | * | 4/1992 | Box | 156/109 |
| 5,107,655 | A | | 4/1992 | Lindgren | |
| 5,177,916 | A | | 1/1993 | Misera et al. | |
| 5,251,417 | A | | 10/1993 | Yates, Jr. | |
| 5,295,292 | A | | 3/1994 | Leopold | |
| 5,313,761 | A | | 5/1994 | Leopold | |
| 5,364,921 | A | | 11/1994 | Gray et al. | |
| 5,437,902 | A | | 8/1995 | Itoh et al. | |
| 5,494,715 | A | * | 2/1996 | Glover | 156/107 |
| 5,533,314 | A | * | 7/1996 | Kunert | 156/109 |
| 5,544,454 | A | | 8/1996 | Richardson et al. | |
| 5,568,714 | A | | 10/1996 | Peterson | |
| 5,640,828 | A | * | 6/1997 | Reeves et al. | 428/34 |
| 5,653,073 | A | | 8/1997 | Palmer | |
| 5,665,823 | A | | 9/1997 | Saxena et al. | |
| 5,813,191 | A | * | 9/1998 | Gallagher | 52/204.5 |
| 5,950,398 | A | * | 9/1999 | Hubbard | 49/463 |
| 6,055,783 | A | | 5/2000 | Guhl et al. | |
| 6,131,364 | A | * | 10/2000 | Peterson | 52/172 |
| 6,209,269 | B1 | | 4/2001 | Valderrama | |
| 6,286,288 | B1 | | 9/2001 | France | |
| 6,295,788 | B2 | * | 10/2001 | Reichert | 52/172 |
| 6,401,428 | B1 | * | 6/2002 | Glover et al. | 52/786.1 |

FOREIGN PATENT DOCUMENTS

| | | |
|---|---|---|
| DE | 26 07 287 | 8/1977 |
| DE | 27 23 283 | 4/1979 |
| DE | 89 01 593 | 3/1989 |
| DE | 38 25 580 | 2/1990 |
| EP | 0 065 510 | 11/1982 |
| EP | 0 328 823 | 8/1989 |
| EP | 0 381 646 | 8/1990 |
| FR | 1079389 | 11/1954 |
| FR | 60912 | 2/1955 |
| FR | 1429980 | 1/1966 |
| FR | 1 459 169 | 4/1966 |
| FR | 2420014 | 11/1979 |
| FR | 2501773 | 9/1982 |
| FR | 2518158 | 6/1983 |
| FR | 2612244 | 9/1988 |
| FR | 2624545 | 6/1989 |
| FR | 2648178 | 12/1990 |
| FR | 2 653 470 | 4/1991 |
| FR | 2 672 930 | 8/1992 |
| FR | 2708030 | 1/1995 |
| GB | 234987 | 6/1925 |
| GB | 949997 | 2/1964 |
| GB | 1 535 173 | 12/1978 |
| GB | 2 077 834 | 12/1981 |
| GB | 2 254 358 | 10/1992 |
| HU | 185 075 | 10/1983 |
| HU | 219 640 | 3/1996 |
| IT | 628775 | 11/1961 |
| SU | 726293 | 4/1980 |
| WO | 91/08366 | 6/1991 |
| WO | 98/02632 | 1/1998 |
| WO | 98/25001 | 6/1998 |

* cited by examiner

INSULATING GLASS SASH ASSEMBLIES WITH ADHESIVE MOUNTING AND SPACING STRUCTURES

BACKGROUND OF THE INVENTION

1. Field of the Invention

The present invention relates generally to residential, commercial, and architectural windows and, more particularly, to an integrated multipane window unit and sash assembly and a method for manufacturing the same.

2. Description of the Related Art

As is currently well-known in the art, insulating glass units, or IG units, are widely used as elements of windows, skylights, doors and related products, including vehicles. Such units are used to reduce heat loss from building interiors in winter, and reduce heat gain into air-conditioned buildings in summer. The insulating glass units are typically formed separately from the sash, and then in a separate step the insulating glass unit is installed in a sash.

A detailed description of the manufacture and installation of conventional IG units can be found in J. France U.S. patent application Ser. No. 09/307,825 filed on May 7, 1999, entitled "Integrated Multipane Window Unit and Sash Assembly and Method for Manufacturing the Same", now U.S. Pat. No. 6,286,288, corresponding to PCT published application WO 00/68539 dated Nov. 16, 2000, both incorporated herein by reference. In addition to providing a comprehensive explanation of the prior art, the aforementioned patent discloses an improved but less complex insulating glass structure that is integrated with the window sash.

More particularly, the aforementioned patent discloses a multipane window unit in which a sash frame is formed having an integral spacing structure upon which glazing panes are directly affixed. The integral spacing structure provides vertical internal glazing surfaces extending from the sash. Adhesive can be affixed to the vertical internal glazing surfaces to attach the glazing panes. In this manner, a rigid, structural sash frame is formed prior to attachment of the glazing panes, thereby eliminating the need for using separately manufactured insulating glass units, while obtaining similar and improved thermal benefits.

The present invention provides further improvements to insulating glass structures for use in windows, doors and the like, while incorporating the basic concept of the aforementioned patent, i.e., the provision of a sash and IG unit in an integrated structure. In particular, the present invention provides, inter alia, an integrated insulating glass and sash structure where parallel glass panes are directly mounted to and supported on the sash by an adhesive mounting or an adhesive mounting and spacing structure. Advantageously, such an adhesive can be applied to the sash directly in the form of a heavy bead (e.g., strip), such as a bead of sealant which can also function as the spacer element between the glass panes. Alternatively, the adhesive can be co-extruded (or post-extruded) with the sash profile. Still further, the adhesive can comprise an integrated, single component desiccated sealant-adhesive glazing material. In a particularly advantageous embodiment, this material can be preformed into a variety of shapes and sizes, thereby providing, when adhered to the sash profile, an integrated sash/glazing mechanism.

It is noted that although the invention is described using glass panes, panes of other materials can be substituted. Such panes can comprise, for example, clear or frosted plastic, such as Plexiglas, tempered glass, safety glass, security glass, privacy glass, or any other known glazing material.

SUMMARY OF THE INVENTION

In accordance with the invention, a multipane window unit is provided in which a window sash provides a structural frame having an inside perimeter. Glazing panes are mounted within the inside perimeter onto a spacing and mounting structure formed integrally with and extending from a main structural portion of the window sash. The spacing and mounting structure is formed from an adhesive applied along the inside perimeter of the sash. A first glazing pane is mounted to a first side of the adhesive spacing and mounting structure. A second glazing pane is mounted to a second side of said adhesive spacing and mounting structure. The spacing and mounting structure maintains planar window surfaces of the first and second glazing panes substantially parallel to each other with a fixed space therebetween, such that the glazing panes are isolated from one another. In a preferred embodiment, the glazing panes float on the adhesive spacing and mounting structure and function independently with respect to stresses.

The adhesive spacing and mounting structure can comprise, for example, a sealant that is applied to the sash by co-extrusion with the sash profile. Alternatively, the adhesive spacing and mounting structure can be post-extruded onto the sash profile, or applied separately after the sash profile extrusion process is completed. In the latter instance, the adhesive spacing and mounting structure can be applied to the sash profile material either before or after a sash frame is constructed from the sash profile material. For example, the adhesive spacing and mounting structure can be robotically applied to the inside perimeter of a finished sash frame, and then the glass panes can be immediately set onto the adhesive spacing and mounting structure in order to form a finished insulating glass sash assembly. In one illustrated embodiment, ribs are formed on the sash profile, extending from the inside perimeter, in order to provide an application surface of increased area for the adhesive spacing and mounting structure. The ribs can also serve to provide additional structural rigidity for the glass panes when mounted to the adhesive spacing and mounting structure.

Various materials can be used alone or in combination for the adhesive spacing and mounting structure, including foams, tapes, chemical sealants, silicone materials which may be cured, e.g., by heat, air, light, ultraviolet (UV) radiation, or the like, and/or other viscous adhesive compounds designed to meet the necessary structural and sealing requirements of the window units. Moreover, the adhesive spacing and mounting structure can be combined with a desiccant to provide an integrated sealant/adhesive glazing structure which also functions to maintain the air or other gas between the glass panes dry. The adhesive spacing and mounting structure can also be designed to block the outgassing of volatile compounds from the material, e.g., PVC, which forms the sash frame. Such "volatiles" are a problem in the insulating glass window industry, as they can cause deposits on the inside surfaces of the glass panes which result in fogging.

In one illustrated embodiment, edges of the glazing panes are at least partially embedded into the adhesive spacing and mounting structure. The adhesive mounting structure can also include at least one receptacle for a muntin assembly. The receptacle can comprise a groove for a muntin clip.

Also disclosed is the use of an adhesive bead bridging a base of the sash profile and edges of the glazing panes, and extending along an outer viewing surface of the glazing panes.

Another embodiment of an integrated multipane window sash in accordance with the invention provides a first strip of adhesive material applied to the inside perimeter of the sash frame. The adhesive material has sufficient stiffness to function as a mounting structure for a glazing pane. A first glazing pane is mounted to the first strip of adhesive material. A second strip of the adhesive material is applied to the inside perimeter substantially parallel to said first strip. A second glazing pane is mounted to the second strip of adhesive material. It is noted that in fabricating a window sash, the adhesive material could be carried by the glazing panes, such that the adhesive is "applied" to the inside perimeter of the sash frame via the glazing panes, when the latter are mounted to the sash. Such an application of the adhesive to the sash frame is intended to be covered by the present invention and the claims set forth hereinafter.

The first glazing pane can be mounted to the first strip of adhesive material via an inside surface of the pane, with the second glazing pane being mounted to the second strip of adhesive material via an outside surface of the pane. Alternatively, both glazing panes can be mounted to their respective strips of adhesive material via an inside surface of the pane, or both can be mounted via an outside surface of the pane.

At least one additional strip of adhesive material can be applied to the inside perimeter for mounting at least one additional glazing pane. The strip(s) of adhesive material can be applied to the inside perimeter of the sash frame as at least one of a bead of adhesive, a preformed adhesive foam, a preformed adhesive tape, or a chemical sealant. Edges of the glazing pane can be at least partially embedded into their respective adhesive mounting strips.

Methods for assembling multipane window units using the disclosed adhesive spacing and mounting structure are also provided in accordance with the invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE INVENTION

Figure 1:
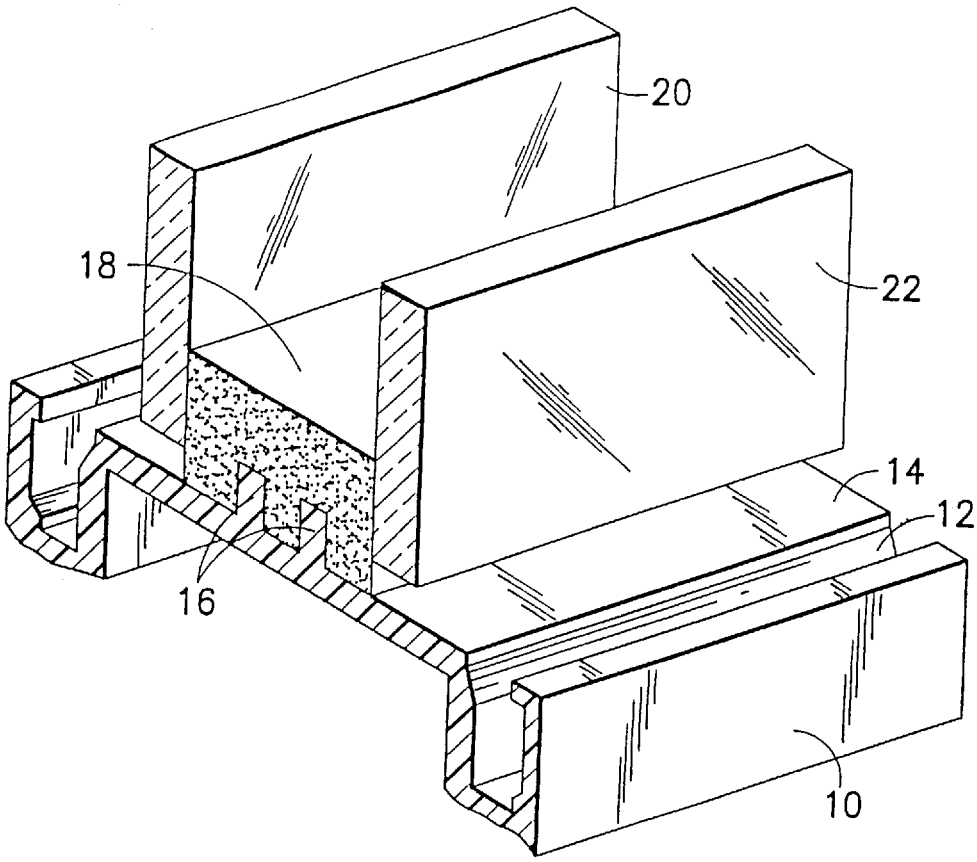
FIG. 1 is a perspective view showing a window sash profile portion with reinforcing ribs, the profile having insulating glass mounted thereto via an adhesive spacing and mounting structure in accordance with the invention.
Figure 2:
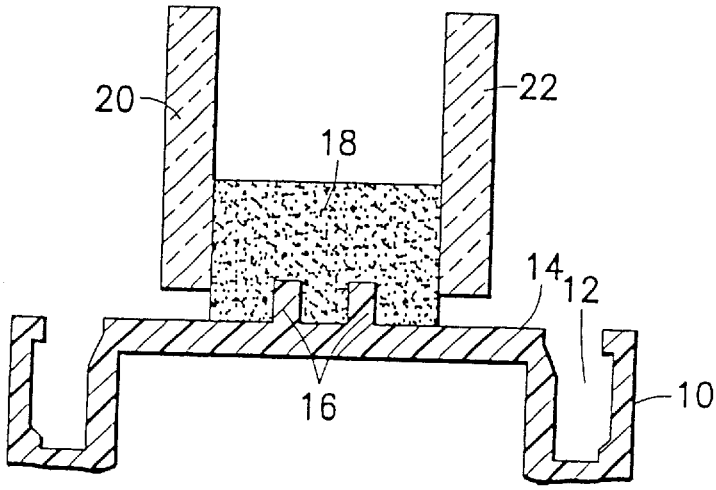
FIG. 2 is a front plan view of the embodiment of FIG. 1.
Figure 7:
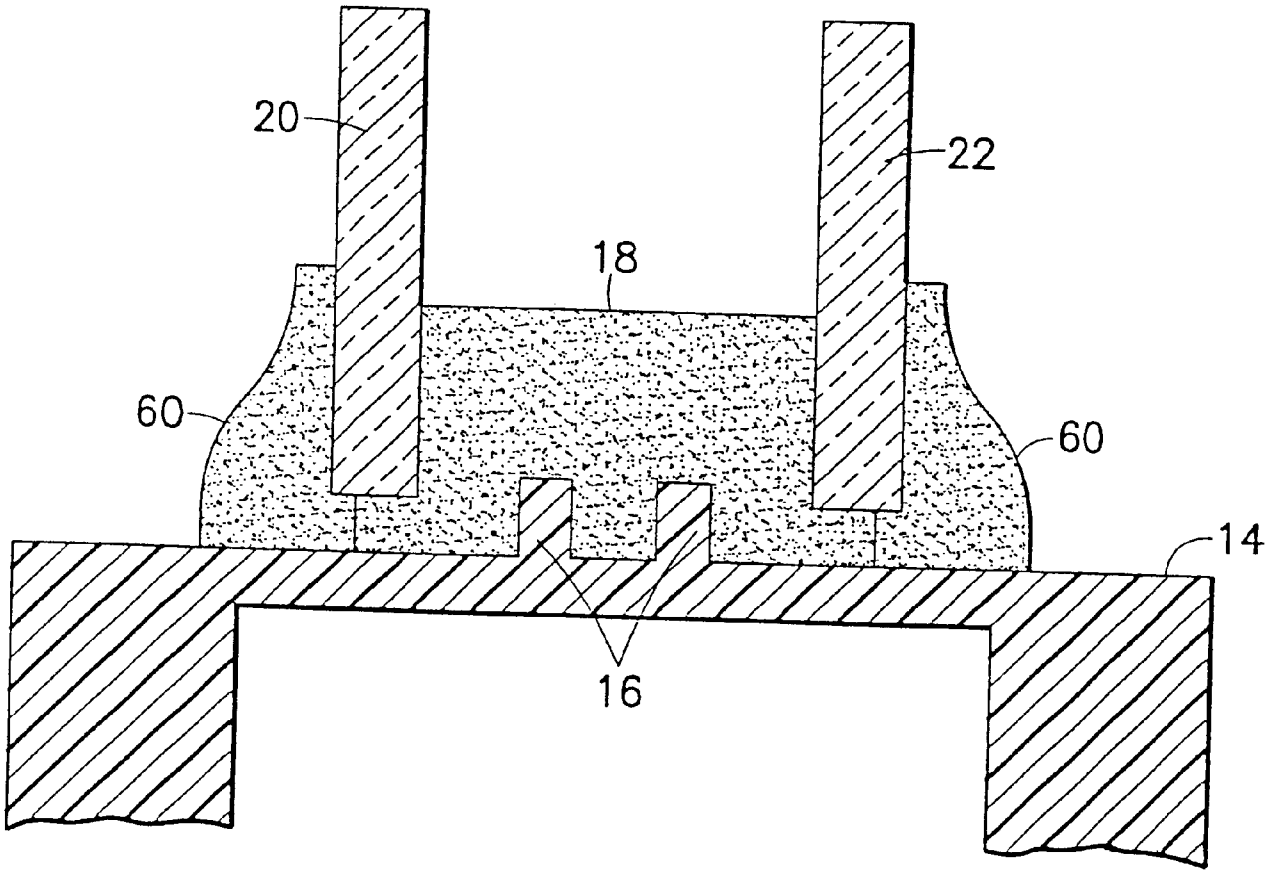
FIG. 7 is a cross-sectional view of an embodiment where the glazing panes are partially embedded in the adhesive spacing and mounting structure and an adhesive bead is used to replace a conventional glazing bead.

Referring now to FIGS. 1 and 2, a sash profile 10, which may be fabricated from vinyl, e.g., polyvinyl chloride (PVC) or any other material used for window frames, such as aluminum, wood, other plastics and the like, is provided for use in manufacturing an insulating glass window. The sash profile can fabricated in any known manner, for example, by extrusion or injection molding. Although only a short section of the profile 10 is illustrated, it should be appreciated that the profile material will be provided in various lengths necessary to assemble a complete sash frame, which may be square, rectangular, oval, circular, or any other custom window shape as well known in the art. The illustrated profile 10 includes a channel 12 for retaining a glazing bead or clip (not shown) as well known in the art. In accordance with the present invention, the prior art glazing bead technology can be replaced with a bead of adhesive sealant 60, as shown in FIG. 7, which could provide a dual sealed unit. For example, a bead of sealant can be applied adjacent to each glazing pane and the base 14 of the sash profile to cover the edges of the glass and define the viewing opening in an aesthetically pleasing manner. Preferably, the bead of adhesive sealant will match the sash profile in color. Alternatively a neutral color or translucent bead can be used. Moreover, the bead can be of any shape, such as the decorative shape illustrated in FIG. 7, a simple quarter round bead, or the like. Still further, it is desirable (although not necessary) to have the top of the bead extend above the top of the adhesive spacing and mounting structure, so that the sides of the adhesive spacing and mounting structure will not be visible through the finished window. Various sealants, including silicone sealants, are suitable for use in forming the bead 60. Preferably, the material will be one that is and remains flexible, such that the glazing panes can float on the adhesive spacing and mounting structure without being locked in place by the bead 60, which may cause undesirable stresses to occur with thermal expansion and contraction, atmospheric pressure changes, and the like.

In an alternate embodiment, the sealant 60 can be one that dries substantially hard, having the appearance that it is part of the sash profile itself. In such an embodiment, the sealant does not have to make actual contact with the glass pane, but it would have to be in close proximity to the glass pane for aesthetic reasons. Obviously, if the sealant does not contact the glass, a double sealed unit will not result.

Sash profile 10 includes an inside perimeter portion 14 (sometimes referred to herein as the sash profile "base"), which, in the embodiment illustrated in FIGS. 1 and 2, includes ribs 16 extending therefrom. The ribs are provided to reinforce an adhesive spacing and mounting structure 18, which can comprise any one or more of a plurality of different materials, such as foams, tapes, chemical sealants, silicone materials which may be cured, e.g., by heat, air, light, ultraviolet (UV) radiation, or the like, and/or other viscous adhesive compounds designed to meet the necessary structural and sealing requirements of insulating glass windows. Where a preformed adhesive spacing and mounting structure 18 is used, such as a rigid, semi-rigid or flexible foam, grooves can be provided therein which mate with the ribs 16. Where a viscous substance (e.g., a chemical sealant) is used for the adhesive spacing and mounting structure, the substance is applied such that it conforms to and surrounds the ribs. Such application can be made, for example, by extruding along with the sash profile, by extruding after the profile is extruded, by application as a bead after extrusion of the profile, or by any other suitable manual or automatic (e.g., robotic) application technique. It should also be appreciated that the structure of the ribs 16 shown in FIGS. 1 and 2 is for purposes of illustration only, and any number of ribs having any suitable shape, such as a "J" or "L" shape, may be used for purposes of providing reinforcement to the adhesive spacing and mounting structure 18. The ribs can also function to guide a robotic arm or the like during application of the adhesive.

The surface of the base 14 of the sash profile and/or the surface of the ribs 16 can be roughened, if necessary, to provide an improved bond with the adhesive spacing and mounting structure. Other surface treatments can also be provided, e.g., during the sash profile extrusion process, to improve the ultimate bond with the adhesive material. For example, a bonding agent or co-extruded material can be applied to the inside perimeter of the sash profile prior to application of the adhesive spacing and mounting structure.

The adhesive spacing and mounting structure is used to attach glass panes 20 and 22 to the sash profile 10. Although only two panes are illustrated in the Figures, it should be appreciated that the invention can be used with windows having three or more panes, as well. As can be seen, the spacing and mounting structure extends from the base 14 of the window sash, and will define a viewing perimeter smaller than the inside perimeter of the sash frame. The glass panes adhere to the structure 18 due to its adhesive nature, and when assembled in the sash frame in this manner, an integrated sash and insulating glass structure results.

The adhesive spacing and mounting structure of the present invention can have any shape that is suitable for mounting the glass panes to the sash profile. Thus, the substantially rectangular cross section of adhesive spacing and mounting structure 18 illustrated in FIG. 2 is an example only. The basic requirements for the adhesive spacing and mounting structure 18 are that it has enough adhesive strength and structural rigidity to securely hold the glass panes onto the sash profile. Moreover, it must provide a hermetic seal for the space between the glass panes. It must also provide the desired spacing between the panes, which will be a function of how wide the adhesive spacing and mounting structure is when it is applied to the sash profile. The adhesive spacing and mounting structure should also be a thermal insulator, in order to avoid the problems of prior art metal spacer structures which result in windows that are prone to condensation at the viewing area edges. Still further, the adhesive spacing and mounting structure should include a desiccant, either combined therewith or provided, e.g., as a coating thereon.

Figure 3:
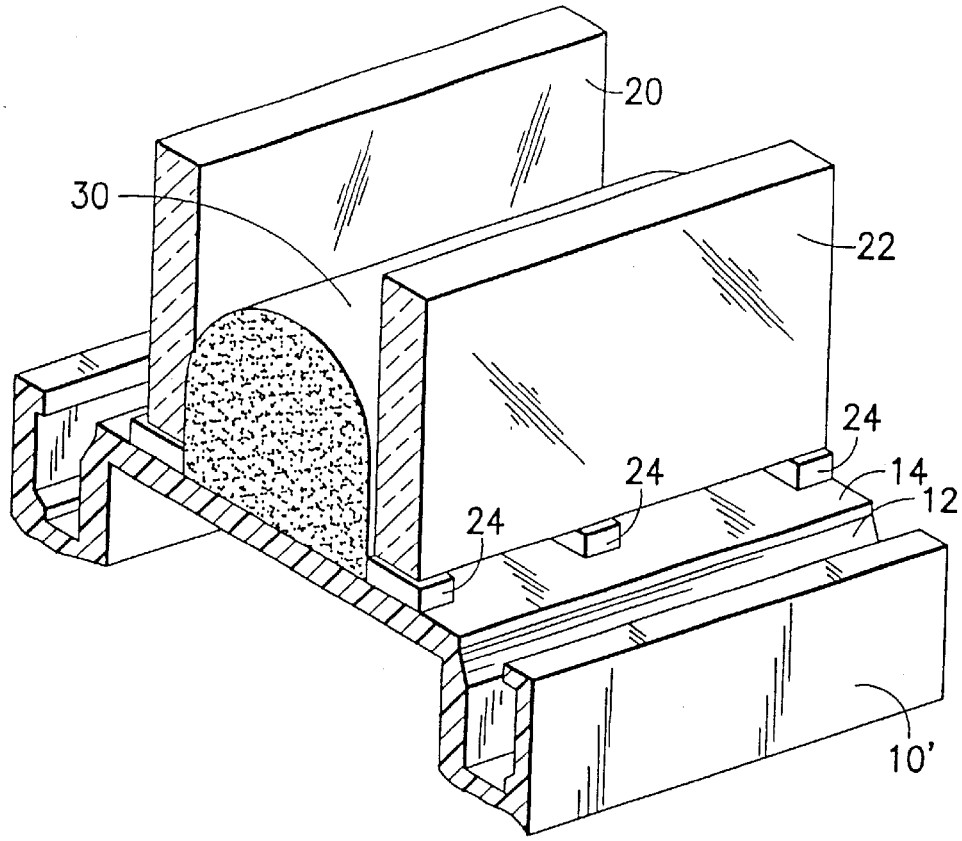
FIG. 3 is a perspective view showing a window sash profile portion without reinforcing ribs, the profile having insulating glass mounted thereto via an adhesive spacing and mounting structure in accordance with the invention.
Figure 4:
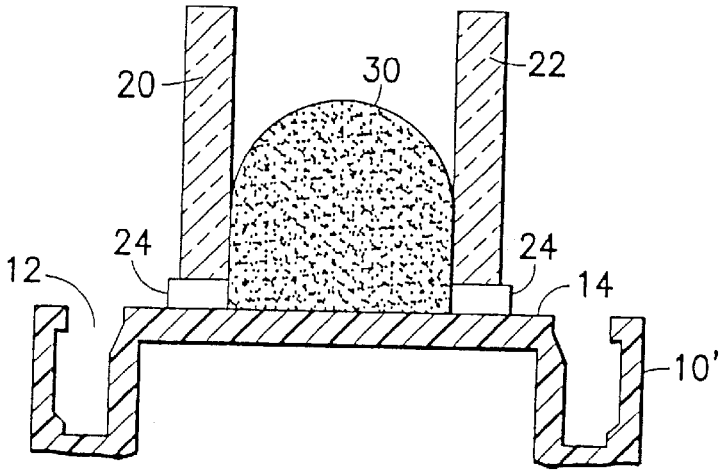
FIG. 4 is a front plan view of the embodiment of FIG. 3.

Another example shape for the adhesive spacing and mounting structure 18 is illustrated in FIGS. 3 and 4. In this example embodiment, the adhesive spacing and mounting structure 30 has an inverted U-shape with respect to the base 14 of the sash profile 10'. It is noted that the example implementation shown in FIGS. 3 and 4 does not include ribs as part of the sash profile. However, ribs 16 such as those shown in FIGS. 1 and 2 could be provided, if desired.

FIGS. 3 and 4 also illustrate the use of setting blocks 24. These blocks can be formed integrally with the sash profile 10', or can be separately attached to the base 14 of the sash profile. The purpose of the setting blocks 24 is to provide a fixed stop for the glazing panes 20, 22. The setting blocks 24 also function to raise the glazing panes away from the elements, such as water, moisture, or even incompatible sealants. The use of such setting blocks 24 can also facilitate the automated placement and proper location of the glazing panes 20, 22. As an alternative to the setting blocks 24, a continuous setting strip can be extruded along with the sash profile. Where a setting strip is used, it is preferable to provide openings, such as holes, spaced along the strip in order to allow volatiles from the adhesive spacing and mounting structure and/or from the sash profile to escape (i.e., outgas), if necessary.

Figure 5:
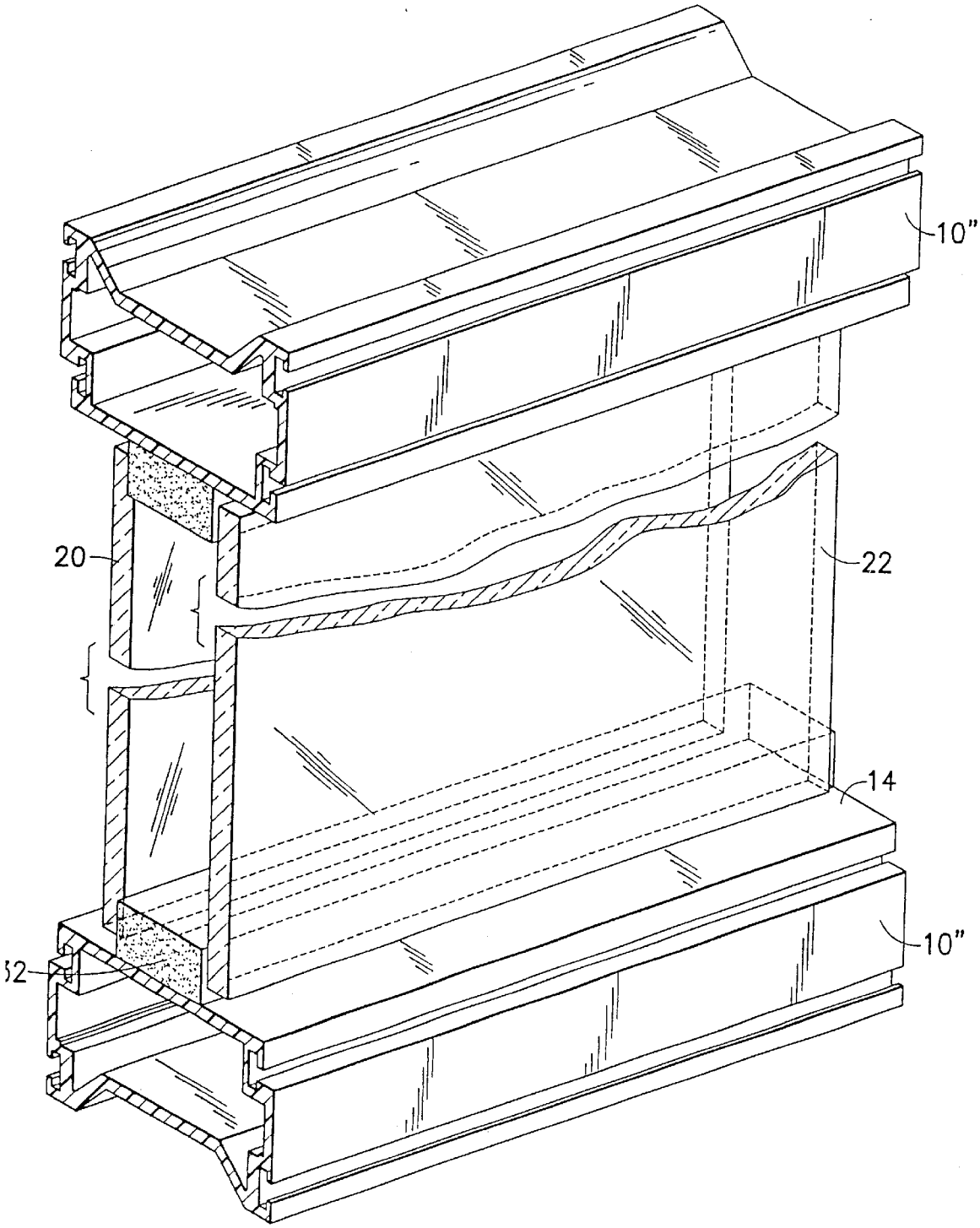
FIG. 5 is a perspective cross-sectional view of a portion of a window sash assembly in accordance with the invention.

FIG. 5 illustrates a portion of a completed sash assembly in accordance with the invention. Although only horizontal sash profiles 10" are illustrated, it should be appreciated that the assembly will also have vertical sash profiles to complete the window opening. The adhesive spacing and mounting structure 32 illustrated in FIG. 5 has a rectangular cross-section, although as noted above, any suitable shape can be used, with or without setting blocks, a setting strip and/or ribs as described above. Moreover, the edges of glazing panes 22 could be embedded into the adhesive spacing and mounting structure 32, either fully or partially. Where the glazing panes 20, 22 are fully embedded into the adhesive spacing and mounting structure, setting blocks or strips will not be necessary (although they can still be provided), as the adhesive spacing and mounting structure 32 itself will provide similar functionality.

Figure 6:
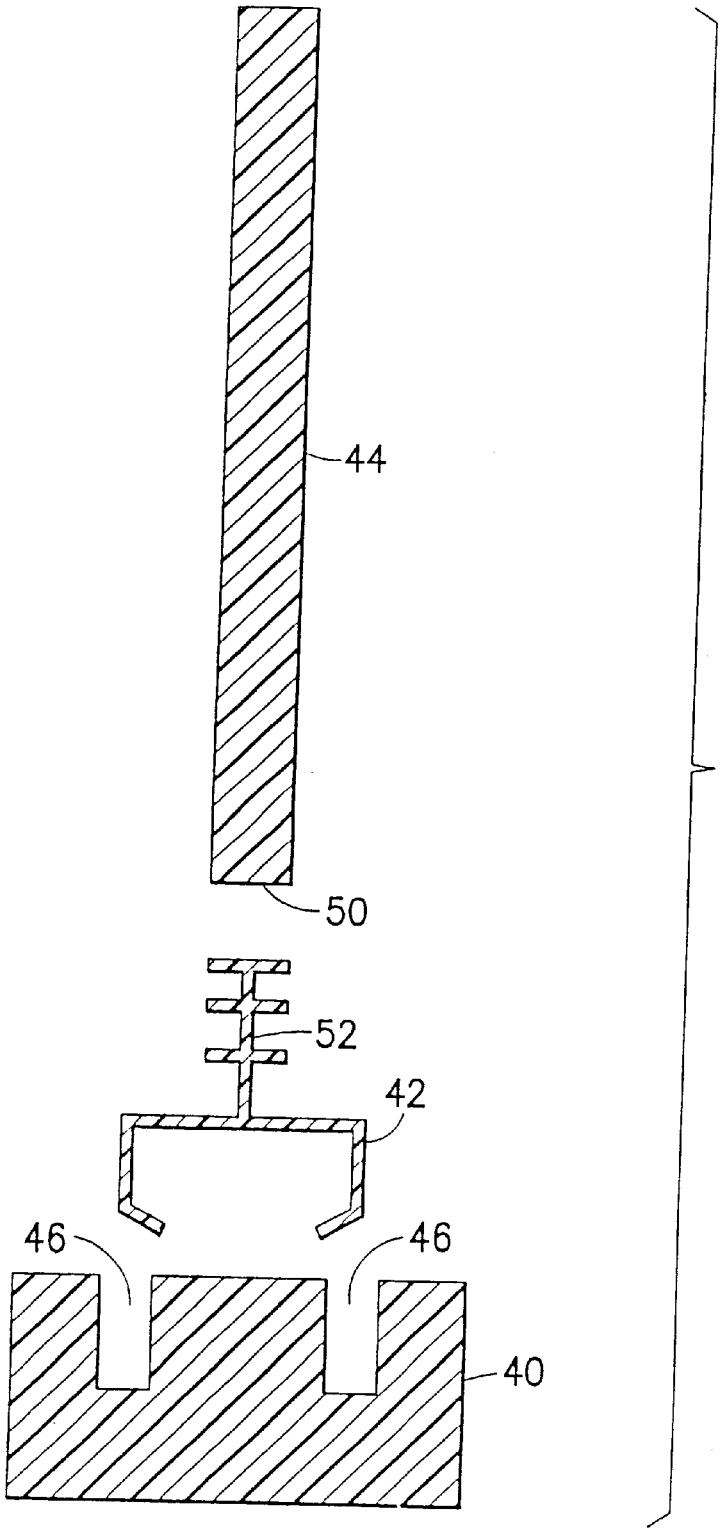
FIG. 6 is an exploded cross-sectional view of an adhesive spacing and mounting structure having channels for holding a muntin assembly in accordance with the invention.

FIG. 6 is an exploded cross sectional view of an adhesive spacing and mounting structure 40 in accordance with the invention, which includes receptacles 46 for receiving a muntin clip 42. The muntin clip 42, in turn, receives a simulated muntin bar 44 which has a hollow (female) end 50 adapted to receive a male retaining portion 52 of clip 42. In this manner, the adhesive spacing and mounting structure 40 can support a simulated muntin assembly between the glazing panes, providing, e.g., a window unit with a colonial appearance. Other size and shape clips can be used, together with corresponding receptacles at both the simulated muntin bar 44 and the adhesive spacing and mounting structure 40. Moreover, the muntin bar 44 could provide a male insert and the muntin clip could provide a female receptacle, instead of the opposite arrangement illustrated. Thus, the implementation illustrated in FIG. 6 is only an example showing how one or more muntin bars 44 can be mounted between the glazing panes.

FIG. 7 illustrates an embodiment where the glazing panes 20, 22 are partially embedded in the adhesive spacing and mounting structure 18. As described above, either full or partial embedding can be provided. FIG. 7 also illustrates the adhesive bead 60 which, as described above, can be used instead of a conventional plastic or metal glazing bead. It is noted that the embedding and adhesive bead features illustrated in FIG. 7 are independent features of the present invention, and do not have to be used together.

Figure 8:
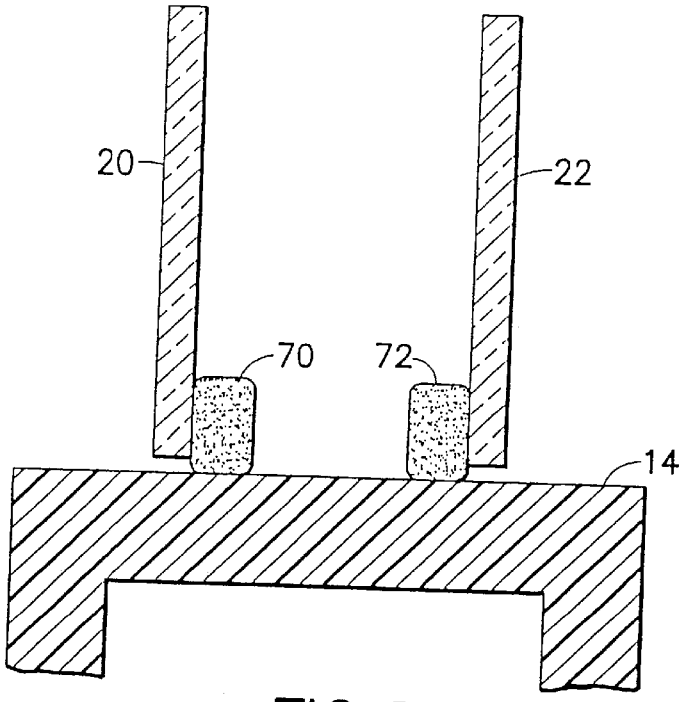
FIG. 8 is a cross-sectional view of an alternative embodiment of the invention wherein two separate adhesive mounting strips or beads are used instead of the adhesive spacing and mounting structure shown in FIGS. 1 to 7.

FIG. 8 illustrates an embodiment of the invention wherein each glazing pane 20, 22 is mounted to the base 14 of the sash using a separate bead or strip of adhesive. As shown, pane 20 is adhesively mounted via a first strip of adhesive material 70, and pane 22 is adhesively mounted via a second strip of adhesive material 72. The adhesive strips (e.g., beads) must be made from a material such as foam, tape, chemical sealants, silicone materials which may be cured, e.g., by heat, air, light, ultraviolet (UV) radiation, or the like, and/or other viscous adhesive compounds designed to meet the necessary structural and sealing requirements of the window units.

Figure 9:
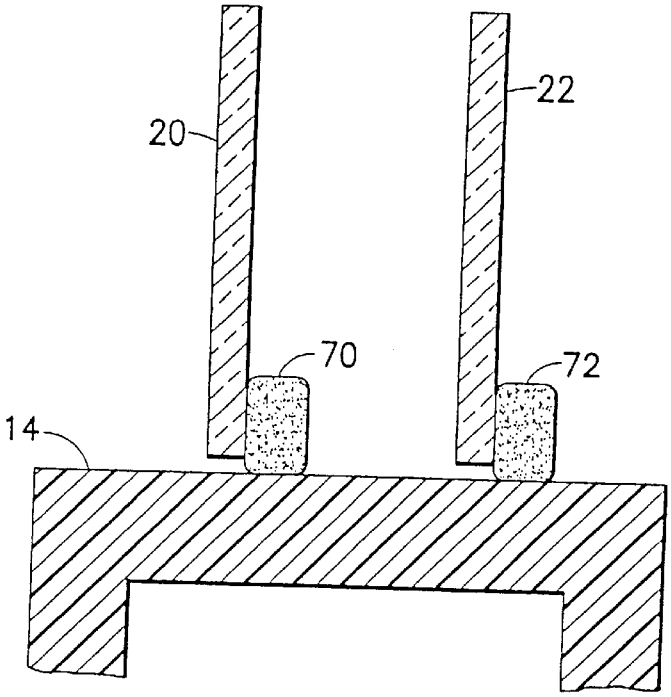
FIG. 9 is a cross-sectional view of another embodiment similar to that shown in FIG. 8, but wherein the glazing panes are mounted on opposite sides.

FIG. 9 is an embodiment similar to that shown in FIG. 8. However, in FIG. 9, the inside surface of glazing pane 20 is mounted to adhesive mounting structure 70, whereas the outside surface of glazing pane 22 is mounted to adhesive mounting structure 72.

Figure 10:
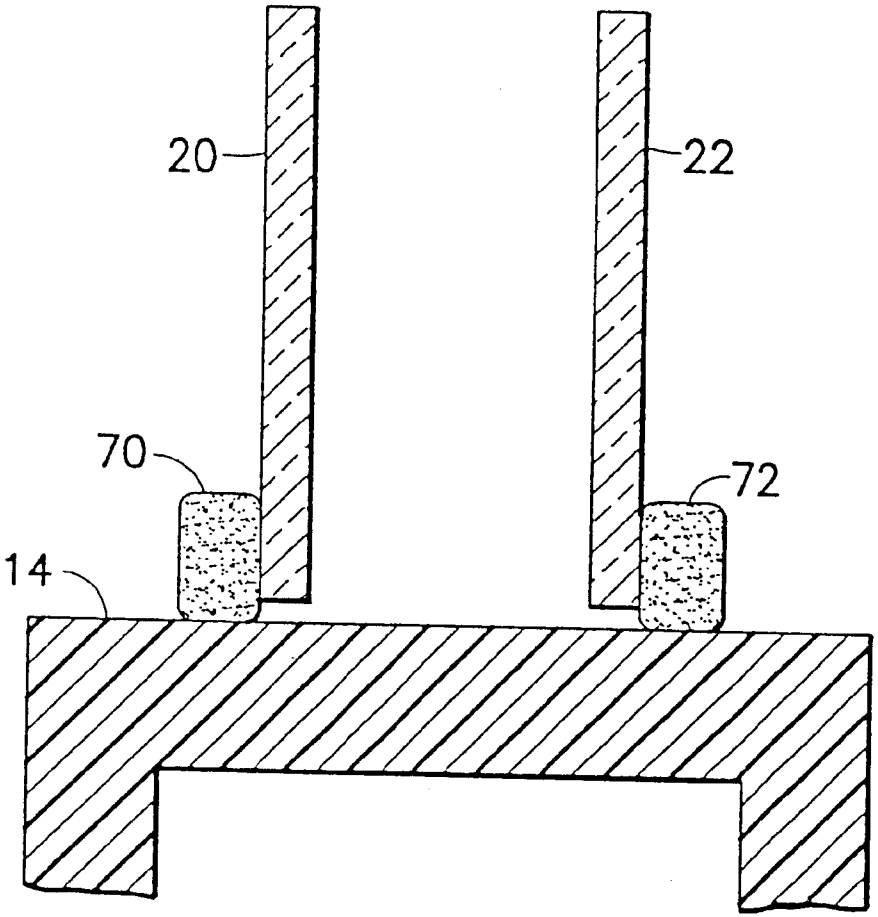
FIG. 10 is a cross-sectional view of another embodiment similar to that shown in FIGS. 8 and 9, but wherein the glazing panes are both mounted via outside surfaces thereof.

FIG. 10 is an embodiment similar to that shown in FIGS. 8 and 9. However, in FIG. 10, the outside surfaces of both glazing panes 20 and 22 are mounted to their respective adhesive mounting structures 70, 72. This has the advantage that the adhesive serves both as a mounting means and as the glazing beads. Those skilled in the art will recognize that in order to fabricate this structure, at least one of the glazing panes may have to be inserted into the sash frame prior to application of the adhesive strip. For example, strip 70 could first be applied, then glazing pane 20 could be mounted thereon. Thereafter, glazing pane 22 could be inserted on top of pane 20, strip 72 could be applied, and pane 20 could then be drawn against strip 72. Other sequences of fabrication could alternatively be performed, such as placing both panes within the sash frame, then applying the adhesive strips, and then drawing the panes against their respective adhesive strips.

The alternative structures and materials discussed in connection with the embodiments of FIGS. 1 to 7 are also applicable to the embodiments of FIGS. 8 to 10. Thus, for example, ribs (such as ribs 16 shown in FIGS. 1 and 2) and glazing blocks or strips (as shown in FIGS. 3 and 4) can be provided in the embodiments of FIGS. 8 to 10, as well as in any of the other embodiments illustrated. A bead of adhesive sealant 60 as described in connection with FIG. 7 can also be provided in any of the embodiments of the invention.

In accordance with the invention, any number of glazing panes can be mounted to a sash frame. For example, a triple glazed unit can be fabricated using one adhesive mounting and spacing structure for two panes, mounted, e.g., as shown in FIGS. 3 and 4, with the third pane mounted to a separate adhesive bead as illustrated in FIG. 8 or 9. Alternatively, separate adhesive beads can be used to mount all three (or more) panes to the sash. Moreover, as is evident from FIGS. 8, 9 and 10, the panes can be mounted on either side thereof.

In FIGS. 8 to 10, the edges of the glazing panes contact their respective adhesive strips, but are not embedded in the adhesive. It should be appreciated, however, that the panes could also be partially or completely embedded in the strips, as discussed in connection with FIG. 7. In order to desiccate the space between the glazing panes in the embodiments of FIGS. 8 and 9, a separate desiccant can be placed in the space between the adhesive strips 70, 72 (FIG. 8), in the space between adhesive strip 70 and glazing pane 22 (FIG. 9), or the adhesive material used to form the strips can be impregnated with a desiccant material. In the latter case, only adhesive strip 70 would have to be desiccated in the embodiment of FIG. 9, unless a third glazing pane is provided in a manner that would result in strip 72 being sealed between respective panes. In the embodiment of FIG. 10, the desiccant would be placed in the space between the glazing panes 20, 22.

In the preferred embodiments, the adhesive strips of FIGS. 8 to 10 will have enough structural support to maintain a consistent desired spacing between the substantially parallel glazing panes. However, where this is not the case, intermittent spacing bars, tabs or similar spacer structures can be integrally formed on or mounted to the base 14 of the sash profile, in order to maintain the proper spacing.

It should now be appreciated that the present invention provides an integrated sash structure, which includes a sash frame, an adhesive mounting structure applied to the sash frame, and glazing panes (such as glass or plastic) mounted to the adhesive mounting structure. The resulting assembly provides a single unit insulating glass sash without the need to manufacture a separate insulating glass (IG) unit, which must then be mounted into a separate sash frame. Instead, a sash profile (which can be easily extruded or injection molded from vinyl or the like) is formed into a frame, an adhesive spacing and mounting structure (or just an adhesive mounting structure, as shown in FIGS. 8 and 9) is applied to an inside perimeter of the frame, and the glazing panes are applied directly to the adhesive. Alternatively, the adhesive mounting structure (or spacing and mounting structure) can be co-extruded with the sash profile, or applied to the profile (e.g., by post-extrusion) prior to the formation of the sash frame from the profile material.

Moreover, an integrated one component desiccated/sealant-adhesive is provided for the mounting (or mounting and spacing) structure. The material used for the adhesive structure is desiccant loaded and allows for the glazing pane to be directly adhered to its side wall.

Although the invention has been described in connection with several particular embodiments, it will be appreciated that various adaptations and modifications may be made thereto without departing from the scope of the invention, as set forth in the claims.

What is claimed is:

1. A multipane insulating window formed directly from an integrated window sash and spacing structure, comprising:

a sash frame having an inside perimeter;

at least one adhesive material applied to said inside perimeter and extending from said inside perimeter toward the center of a glazing opening within said sash frame, said at least one adhesive material continuing substantially around the entire inside perimeter of said sash frame to provide an adhesive spacing and mounting structure for supporting subsequently applied glazing panes;

a first glazing pane of a size smaller than said glazing opening mounted to a first side of the adhesive spacing and mounting structure within said glazing opening; and a second glazing pane of a size smaller than said glazing opening mounted to a second side of the adhesive spacing and mounting structure within said glazing opening;

wherein an insulating glass structure is formed directly in said glazing opening without a mounting structure for a prefabricated insulating glass unit.

2. The integrated window sash of claim 1, wherein the adhesive spacing and mounting structure comprises a sealant that is applied to the sash by co-extrusion with a sash profile used to fabricate said sash frame.

3. The window of claim 1, wherein the adhesive spacing and mounting structure is post-extruded onto a sash profile used to fabricate said sash frame.

4. The window of claim 1, wherein the adhesive spacing and mounting structure comprises at least one of a bead of adhesive, a preformed adhesive foam, or a preformed adhesive tape.

5. The integrated window sash of claim 4 wherein said adhesive spacing and mounting structure is adapted to receive glazing panes immediately after the adhesive spacing and mounting structure is applied to the inside perimeter.

6. The window of claim 1, further comprising at least one rib extending from the inside perimeter of said sash frame for providing at least one of:

(i) an increased surface area for the application of said adhesive spacing and mounting structure, (ii) additional structural rigidity when glazing panes are mounted to the adhesive spacing and mounting structure.

7. The window of claim 1, wherein the adhesive spacing and mounting structure, comprises at least one of: (i) a foam, (ii) a tape, (iii) a sealant.

8. The window of claim 1, wherein the adhesive spacing and mounting structure comprises an adhesive combined with a desiccant.

9. The window of claim 1, wherein the adhesive spacing and mounting structure has edges of said glazing panes at least partially embedded therein.

10. The window of claim 1, wherein the adhesive spacing and mounting structure includes at least one receptacle for a muntin assembly.

11. The window of claim 10, wherein said receptacle comprises a groove for a muntin clip.

12. The window of claim 1, further comprising an adhesive bead bridging a base of the sash profile and edges of glazing panes applied to the spacing and mounting structure, said bead extending along an outer viewing surface of the glazing panes.

13. The window of claim 12, wherein said adhesive bead is flexible.

14. The window of claim 1, wherein said adhesive material has sufficient stiffness to function as said spacing and mounting structure without supplemental support.

15. The window sash of claim 1, further comprising:

at least one of:

(i) integral setting blocks, (ii) a continuous setting strip provided along the inside perimeter of the sash frame.

16. The window of claim 1, wherein the adhesive spacing and mounting structure blocks outgassing.

17. A multipane insulating window formed directly from an integrated window sash and spacing structure comprising:

a sash frame having an inside perimeter;

a first strip of at least one adhesive material applied to said inside perimeter and extending from said inside perimeter toward the center of a glazing opening within said sash frame, said first strip of adhesive material continuing substantially around the entire inside perimeter of said sash frame to provide a first glazing pane mounting structure;

a second strip of at least one adhesive material applied to said inside perimeter and extending from said inside perimeter substantially parallel to said first strip toward the center of said glazing opening, said second strip of adhesive material continuing substantially around the entire inside perimeter of said sash frame to provide a second glazing pane mounting structure;

a first glazing pane mounted to said first glazing pane mounting structure; and a second glazing pane mounted to said second glazing pane mounting structure;

wherein an insulating glass structure is formed directly in said glazing opening from said first and second glazing panes and said respective first and second strips.

18. A window in accordance with claim 17, wherein:

the first strip of adhesive material attaches to an inside surface of the first glazing pane, and the second strip of adhesive material attaches to an outside surface of the second glazing pane.

19. A window in accordance with claim 17, wherein:

the first strip of adhesive material attaches to an inside surface of the first glazing pane, and the second strip of adhesive material attaches to an inside surface of the second glazing pane.

20. A window in accordance with claim 17, wherein:

the first strip of adhesive material attaches to an outside surface of the first glazing pane, and the second strip of adhesive material attaches to an outside surface of the second glazing pane.

21. A window in accordance with claim 17, wherein:

at least one additional strip of adhesive material is applied to said inside perimeter for mounting at least one additional glazing pane.

22. A window in accordance with claim 17, wherein at least one of said strips of adhesive material is applied to the inside perimeter of the sash frame as at least one of a bead of adhesive, a preformed adhesive foam, a preformed adhesive tape, or a chemical sealant.

23. A window in accordance with claim 17, wherein said adhesive mounting strips receive respective glazing panes with edges of the glazing panes at least partially embedded therein.

24. A window sash in accordance with claim 17, wherein said adhesive material has sufficient stiffness to function as said spacing and mounting structure without supplemental support.

* * * * *

UNITED STATES PATENT AND TRADEMARK OFFICE

CERTIFICATE OF CORRECTION

PATENT NO. : 6,662,523 B2
DATED : December 16, 2003
INVENTOR(S) : Hornung et al.

It is certified that error appears in the above-identified patent and that said Letters Patent is hereby corrected as shown below:

Column 8,
Lines 55 and 66, delete the words “integrated” and “sash”.

Column 9,
Line 36, delete the word “sash”.

Signed and Sealed this

Sixth Day of April, 2004

JON W. DUDAS
*Acting Director of the United States Patent and Trademark Office*